US012650234B2

(12) United States Patent
Deivasigamani et al.

(10) Patent No.: US 12,650,234 B2
(45) Date of Patent: Jun. 9, 2026

(54) HEATING SYSTEM

(71) Applicant: Intellihot, Inc., Galesburg, IL (US)

(72) Inventors: Sridhar Deivasigamani, Peoria, IL (US); Sivaprasad Akasam, Dunlap, IL (US)

(73) Assignee: Intellihot Inc., Galesburg, IL (US)

( * ) Notice: Subject to any disclaimer, the term of this patent is extended or adjusted under 35 U.S.C. 154(b) by 585 days.

(21) Appl. No.: 18/081,652

(22) Filed: Dec. 14, 2022

(65) Prior Publication Data

US 2024/0200791 A1 Jun. 20, 2024

(51) Int. Cl.

| | |
|---|---|
| ***F24D 19/10*** | (2006.01) |
| ***F24D 11/00*** | (2022.01) |
| ***F24D 17/00*** | (2022.01) |
| ***F24D 19/00*** | (2006.01) |

(52) U.S. Cl.

CPC ..... *F24D 19/106* (2013.01); *F24D 11/003* (2013.01); *F24D 17/0021* (2013.01); *F24D 17/0073* (2013.01); *F24D 19/0095* (2013.01); *F24D 2200/14* (2013.01); *F24D 2220/048* (2013.01)

(58) Field of Classification Search

CPC ..... F24D 11/003; F24D 17/0021; F24D 17/0073; F24D 19/0095; F24D 19/106; F24D 2200/14; F24D 2200/048

USPC ..... 126/615

See application file for complete search history.

(56) References Cited

U.S. PATENT DOCUMENTS

| | | | | |
|---|---|---|---|---|
| 8,073,972 | B2 | 12/2011 | Jansen et al. | |
| 2009/0250203 | A1* | 10/2009 | Ida | F24H 15/335 62/434 |
| 2010/0031953 | A1* | 2/2010 | Penev | F24D 17/0021 165/45 |
| 2015/0267923 | A1* | 9/2015 | Fan | F25B 30/02 62/238.7 |
| 2022/0136711 | A1* | 5/2022 | Leckinger | F24D 19/1063 62/235.1 |

FOREIGN PATENT DOCUMENTS

KR 20180043460 A * 4/2018 ..... F24F 5/0096

OTHER PUBLICATIONS

KR-20180043460-A—Translation (Year: 2018).*

* cited by examiner

*Primary Examiner* — Steven B Mcallister
*Assistant Examiner* — Benjamin W Johnson
(74) *Attorney, Agent, or Firm* — Jong Patent Firm; Cheng Ning Jong; Tracy P. Jong

(57) ABSTRACT

A heating system including a thermal battery including an opening, a storage container configured to hold a first fluid therein, the opening configured to expose the first fluid to atmospheric pressure; and a fluid conductor disposed through the first fluid from an inlet point at the storage container to an outlet point at the storage container, the fluid conductor configured to receive a second fluid at a first temperature at the inlet point and to supply the second fluid at a second temperature higher than the first temperature.

4 Claims, 6 Drawing Sheets

HEATING SYSTEM

BACKGROUND OF THE INVENTION

1. The Field of the Invention

The present invention relates to an electric tankless heating system. More specifically, the present invention is directed to an electric tankless heating system utilizing an improved heat pump.

2. Background Art

In water heating systems, the potential for *Legionella* is more pronounced in a tank system or a large fluid conductor, e.g., in a tank water heater, etc., due to the low velocity of the contents of the tank water heater and the contents that are disposed in a suitable temperature range for *Legionella* proliferation. Although one or more temperature sensors may be used for providing feedback to the heating of the contents of the tank water heater to achieve a setpoint temperature, the effect of stratification can cause layers of fluid having different temperatures. Therefore, although portions of the contents of a water heater may be disposed at a setpoint temperature that is unfavorable for *Legionella* proliferation, there potentially exists other portions that may be disposed at temperatures suitable for *Legionella* proliferation. Further, in a tank heating system, potable water is drawn from a large reservoir of heated water to meet a hot water demand, increasing the risk of *Legionella* proliferation as the opportunity for a tank heating system to harbor *Legionella* is significantly higher than a tankless heating system where hot potable water is prepared just-in-time.

Scaling and corrosion are longstanding problems encountered in the water heating industry which limit the life span of equipment. Although many corrosion and scale inhibitors are known and used in high temperature application, many of these systems have limitations and do not provide the type of protection to allow significant extension of equipment life span. Conventional water heaters cannot store potable water at a very high temp due to the potential for scaling and hence corrosion.

Solar heating systems or heaters have become increasingly popular solutions either as a supplemental heating system or as a sole heating system whether or not municipal electricity is available. Where thermal batteries and swing tanks are involved and are made to function in conjunction with solar heaters, the overall heating solutions are often complicated to set up, involving set up procedures which are not only challenging for trained professionals to set up but also difficult for a user to detect a problem or the root cause of a problem if they malfunction during use. Further, these systems are often not easily scalable as there is very little reuse in the way of common subsystems being sourced as modules that can be added or removed.

Thus, there is a need in the heating art for a system which operates with operating conditions that do not promote scaling and corrosion and therefore do not require the application of conventional scale and corrosion inhibitors. There is also a need in the heating art for a system in which a working fluid can be stored at higher temperatures and hence increased heat transfer efficiency.

SUMMARY OF THE INVENTION

In accordance with the present invention, there is provided a heating system including:

(a) a storage container including an opening, the storage container configured to hold a first fluid therein, the opening configured to substantially expose the first fluid to atmospheric pressure; and (b) a fluid conductor disposed through the first fluid from an inlet point at the storage container to an outlet point at the storage container, the fluid conductor configured to receive a second fluid at a first temperature at the inlet point and to supply the second fluid at a second temperature higher than the first temperature.

In one embodiment, the storage container is a non-pressurized container. In one embodiment, the heating system further includes a heat source configured to supply the first fluid with thermal energy. In one embodiment, the opening includes a trap. In one embodiment, the trap includes a bent portion configured to hold a fluid to prevent intrusion of foreign objects through the opening into the storage container and to at least reduce the escape of the first fluid through the opening. In one embodiment, the storage container further includes an outlet fluid conductor and an inlet fluid conductor, the storage container is configured to hold the first fluid in at least two distinct temperatures, the outlet fluid conductor is disposed at a portion of the storage container exposed to the first fluid disposed at a first temperature of the at least two distinct temperatures and the inlet fluid conductor is disposed at a portion of the storage container exposed to the first fluid disposed at a second temperature of the at least two distinct temperatures, wherein the second temperature of the at least two distinct temperatures is higher than the first temperature of the at least two distinct temperatures. In one embodiment, the storage container is configured to hold the first fluid in at least two distinct temperatures and the inlet point is disposed in the first fluid at a first temperature of the at least two distinct temperatures and the outlet point is disposed in the first fluid at a second temperature of the at least two distinct temperatures and the second temperature of the at least two distinct temperatures is higher than the first temperature of the at least two distinct temperatures. In one embodiment, the first fluid is glycol. In one embodiment, the heating system further comprises a glycol concentration sensor configured for detecting the concentration of the first fluid to determine a suitability of the first fluid to resist freezing. In one embodiment, the heating system further comprises a controller and a glycol concentration sensor functionally connected to the controller, the controller configured for receiving data from the glycol concentration sensor and determining a suitability of the first fluid to resist freezing based on a location data. In one embodiment, the heating system further includes a fill valve configured to fill the storage container. In one embodiment, the heating system further includes an isolation valve connected to the inlet point, wherein the isolation valve is configured for selectively allowing a flow of the second fluid. In one embodiment, the heating system further includes a solar heater and the storage container further includes an outlet fluid conductor and an inlet fluid conductor, wherein the solar heater is connected to the storage container via the outlet fluid conductor and the inlet fluid conductor.

In one embodiment, the present heating system further includes:

(a) a first fluid conductor;

(b) an evaporator thermally connected to the first fluid conductor by a mode of convection;

(c) a second fluid conductor connecting the first fluid conductor to the evaporator; and (d) an expansion valve interposed in the second fluid conductor, wherein a working fluid received at the first fluid conductor is configured to be supplied to the evaporator through the second fluid conductor and the expansion valve, a heat loss from the working fluid in the first fluid conductor is at least compensated by a heat gain by the evaporator due to the working fluid in the first fluid conductor disposed at a lower temperature caused by the heat loss.

In one embodiment, the heating system further includes a heat exchanger including an upstream fluid conductor and a downstream fluid conductor thermally coupled to the upstream fluid conductor, wherein the upstream fluid conductor is configured to be connected to an inlet port of the first fluid conductor and the downstream fluid conductor is configured to be connected to an outlet port of the evaporator and heat transfer is configured to occur from the working fluid in the upstream fluid conductor to the working fluid in the downstream fluid conductor. In one embodiment, the first fluid conductor includes a featureless outer surface. In one embodiment, the working fluid is a refrigerant. In one embodiment, the mode of convection is configured to be aided by a blower.

An object of the present invention is to provide a fluid heating system that is tankless to reduce the potential for the heated output from contamination of pathogens, e.g., *Legionella*.

Another object of the present invention is to provide a non-pressurized storage container, thereby avoiding the additional procurement and maintenance costs associated with a pressurized storage container.

Another object of the present invention is to provide a heating subsystem having improved thermal energy capture rate.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
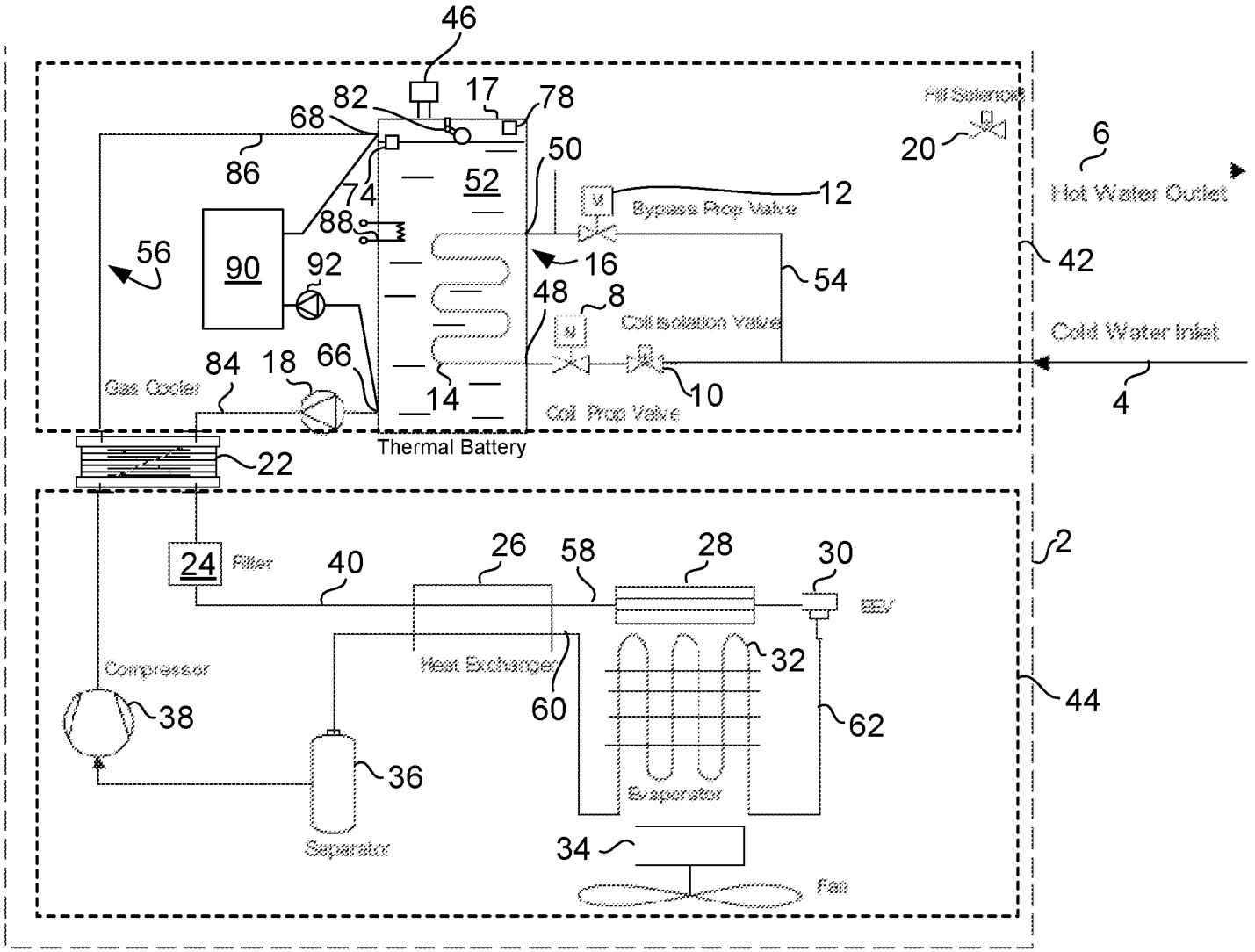
FIG. 1 is a diagram depicting an electric tankless heating system.

2—heating system
4—water inlet
6—water outlet
8—inlet valve
10—coil isolation valve
12—bypass valve
14—fluid conductor or coil
16—thermal battery
17—storage container
18—pump
20—fill valve
22—heat exchanger, e.g., gas cooler
24—filter
26—heat exchanger
28—fluid conductor
30—expansion valve
32—evaporator
34—blower
36—separator
38—compressor
40—fluid conductor
42—subsystem
44—subsystem
46—opening
48—inlet point
50—outlet point
52—first fluid
54—bypass conductor
56—heat supply loop
58—upstream fluid conductor
60—downstream fluid conductor
62—fluid conductor
64—trap
66—inlet to storage container
68—outlet from storage container
70—ambient environment of contents of storage container
72—environment
74—glycol concentration sensor
76—controller
78—level sensor
80—internet
82—float switch
84—outlet fluid conductor
86—inlet fluid conductor
88—resistive heater
90—solar heater
92—pump
94—heat exchanger, e.g., gas cooler

Particular Advantages of the Invention

As the present heating system is an on demand or tankless heating system, only a small amount of fluid is held in the system when no demands exist, significantly reducing the amount of trapped water in the present heating system to harbor *Legionella* as the thermal charging of the contents of the storage container is fluidly decoupled from thermal discharging of the contents of the storage container by a fluid flow through a fluid conductor disposed through the storage container. Even if this small amount of fluid can potentially be grounds for *Legionella* proliferation, it is generally not consumed but rather drained as the user awaits heated water to arrive at the point of use. Further, during use, the potable water traversing the heat exchanger is heated to a range of temperature unsuitable for *Legionella* proliferation, unlike the case of a tank heating system where a suitable temperature range always exists in the tank due to the ever-present stratification of the contents of the tank.

As there is only a small amount of water is kept in the coil disposed through the storage container and the contents of the storage container are not replenished during normal operation of the storage container, the opportunity for the storage container and the heating system to scale is minimal. As there is a limited amount of minerals in the contents of the storage container and the contents of the storage container are reused indefinitely or until the storage container is refilled, no new supply of minerals is available to add to scaling. Further the velocity of the fluid flow through the coil disposed through the storage container is relatively high, minimizing the opportunity for minerals to deposit on the internal surfaces of the coil.

Detailed Description of a Preferred Embodiment

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

FIG. 1 is a diagram depicting a heating system 2. The heating system 2 includes essentially two subsystems, i.e., subsystem 42 which holds an interface between a heat source and a heat sink and subsystem 44 which serves as a heat source. In the embodiment shown, the heat source is an improved heat pump. Each subsystem may herein be individually referred to as a heating system as it either receives heating from another system or subsystem, as in subsystem 42 or it is responsible for supplying thermal energy to another system or subsystem, as in subsystem 44. Regarding subsystem 42, the heating system includes a thermal battery 16 which includes a storage container 17 and a fluid conductor 14 disposed through the storage container 17. The storage container 17 includes an opening 46 and is configured to hold a first fluid therein. The opening 46 is configured to expose the first fluid to atmospheric pressure. As such, the storage container 17 is not a pressurized vessel and not required to withstand pressure exerted by pressurized contents and therefore can be made to meet minimal requirements of a storage container, resulting in an inexpensive, easy-to-fabricate and maintain storage container. Contrast this to conventional thermal batteries where pressurized tanks are used. The container needs not be built to withstand a pressure higher than the ambient pressure and therefore no special materials and container wall thicknesses that are required to provide a container capable of withstanding pressure significantly higher than the ambient pressure. Such a container is therefore ubiquitous, has low procurement and maintenance costs. Referring to subsystem 42, it shall be noted that cold water is received at a cold water inlet 4 with an inlet pipe which connects the cold water inlet 4 to the fluid conductor 14. Heated water is supplied at a hot water outlet 6 via an outlet pipe which connects the fluid conductor 14 to the hot water outlet 6. The fluid conductor 14 is disposed through the first fluid, e.g., glycol, from an inlet point 48 at the storage container 17 to an outlet point 50 at the storage container 17, the fluid conductor 14 is configured to receive a second fluid at a first temperature at the inlet point and to supply the second fluid, e.g., potable water, at a second temperature higher than the first temperature.

In the embodiment shown, subsystem 42 further includes a heat source configured to supply the first fluid 52 with thermal energy via the working fluid exiting the storage container 17 through the outlet fluid conductor 84 and returning to the storage container through the inlet fluid conductor 86. Here, thermal energy is received via a flow motivated by pump 18 through heat exchanger 22. Due to the location of the pump 18 relative to the first fluid 52 in the storage container, it is self-priming. No manual priming is required prior to its use as long as the thermal battery 16 has been properly set up. In one embodiment, the pump 18 is a variable speed pump to allow the system to modulate the flowrate through the heat supply loop 56, thereby affecting the thermal charging rate of the thermal battery 16. For instance, the thermal charging rate of the thermal battery 16 may be correlated to the rate at which thermal energy may be transferred from subsystem 44 to avoid unnecessary circulation of the first fluid 52. The first fluid 52 held in the storage container is stratified, i.e., the temperature of the first fluid near the top of the storage container is disposed at a temperature higher than the first fluid near the bottom of the storage container. Therefore, the inlet point 48 is disposed in the first fluid 52 at a first temperature and the outlet point is disposed in the first fluid 52 at a second temperature where the second temperature is higher than the first temperature. As the first temperature is lower and the thermal energy of the contents in the lower region of the storage container has been largely depleted, this ensures that the first fluid drawn by the pump 18 is devoid of thermal energy and ready to draw thermal energy from heating system 44. In one embodiment, the first fluid is glycol.

Subsystem 42 further includes a fill valve 20 configured to control the filling of the storage container 17. A glycol solution can be formed by adding water via fill valve 20 to glycol already disposed in the storage container 17. A glycol concentration sensor is further provided to determine whether the concentration of glycol is suitable for the locale the heating system is used in. In the embodiment shown, a fluid level sensor 78 is provided to allow the level of the storage container contents to be determined. This allows the exact level of the contents to be determined and the amount of glycol to be replenished. The present heating system is shipped to site with the storage container 17 void of fluid to avoid unnecessary shipment of weighted storage container and the storage container 17 is filled on site to make transportation of the heating system more cost effective and the heating system easier to set up. Subsystem 42 further includes a bypass conductor 54 connecting an inlet and an outlet of the fluid conductor 14. A valve 12 is interposed in the bypass conductor 54 to control the magnitude of a bypass flow that is allowed to occur through the bypass conductor 54. An inlet valve 8 is disposed at the inlet of the fluid conductor 14 to control the magnitude of a flow through the fluid conductor 14. A coil isolation valve 10 is connected to the inlet point 48, wherein the coil isolation valve is configured for selectively allowing a flow of the second fluid. The coil isolation valve 10 serves as a fail-safe mechanism for an inlet valve 8 which fails as the coil isolation valve 10 is a spring-returned valve configured to close automatically should the inlet valve 8, e.g., a proportional valve fails. This way, a failed inlet valve 8 would not inadvertently cause a flow to be heated indefinitely in the thermal battery 16 to cause a scalding hot output at the outlet 6. Once the coil isolation valve 10 is closed, an incoming flow through the cold water inlet 4 will be diverted to the bypass conductor 54. A user of the demand will experience unheated water but will avoid potentially scalding hot water due to the failed inlet valve 8. A pump 18 interposed in a heat supply loop 56 connected to the storage container 17 at an outlet 66 and at an inlet 68, controls the magnitude of circulation of the contents of the storage container 17 and hence controls the rate at which heat energy is supplied to the contents of the storage container 17.

Regarding subsystem 44, the heating system includes a first fluid conductor 28, an evaporator 32, a second fluid conductor 62 and an expansion valve 30. The evaporator 32 is thermally connected to the first fluid conductor 28 by a mode of convection. The second fluid conductor 62 connects the first fluid conductor 28 to the evaporator 32. The expansion valve 30 is interposed in the second fluid conductor 62. A working fluid received at the first fluid conductor 28 is configured to be supplied to the evaporator 32 through the second fluid conductor 62 and the expansion valve 30. Heat loss from the working fluid in the first fluid conductor 28 is at least compensated by a heat gain by the evaporator 32 due to the working fluid in the first fluid conductor 28 disposed at a lower temperature caused by the heat loss. Subsystem 44 further includes a heat exchanger 26 including an upstream fluid conductor 58 and a downstream fluid conductor 60 thermally coupled to the upstream fluid conductor 58. The upstream fluid conductor 58 is configured to be connected to an inlet port of the first fluid conductor 28 and the downstream fluid conductor 60 is configured to be connected to an outlet port of the evaporator 32 and heat transfer is configured to occur from the working fluid in the upstream fluid conductor 58 to the working fluid in the downstream fluid conductor 60. The first fluid conductor 28 includes a featureless outer surface. Applicant discovered that by lowering the temperature of the working fluid going into the expansion valve 30 due to heat loss from the working fluid via the first fluid conductor 28, the heat gained by the working fluid in the evaporator 32 by convection between the first fluid conductor 28 and the evaporator 32 and the evaporator 32 and its surroundings, exceeds the alternative, thereby improving Coefficient of Performance (COP) of the heat pump 44. COP is defined as the relationship between the power that is drawn out of a heat pump as cooling or heat, and the power that is supplied to the compressor, e.g., compressor 38 of the heat pump. However, Applicant also discovered that if the outer surface of the first fluid conductor 28 had been equipped with heat transfer fins, rather than being featureless, heat loss from the working fluid through the first fluid conductor 28 or the temperature drop in the working fluid via convection would have been too severe for the evaporator 32 to regain heat, resulting in a net thermal energy loss instead of a net thermal energy gain as in the case of the featureless first fluid conductor 28. In one embodiment, the working fluid is a refrigerant. The mode of convection is configured to be aided by a blower 34. The upstream fluid conductor 58 and the downstream fluid conductor 60 are fluidly connected via fluid conductor 40. Upon leaving downstream fluid conductor 60, the working fluid flows through a separator 36, where the separator is disposed downstream from the downstream fluid conductor 60. Upon leaving the separator 36, the working fluid flows through a compressor 38 disposed downstream from the separator 36. Upon leaving compressor 38, the working fluid flows through a heat exchanger 22, e.g., a gas cooler, disposed downstream from the compressor 38. The heat exchanger 22 thermally connects fluid conductor 40 of subsystem 44 with heat supply loop 42 of subsystem 42. Upon leaving heat exchanger 22, the working fluid flows through a filter 24. In heat exchanger 22, a gas cooler, thermal energy is transferred from the working fluid in fluid conductor 40 to the working fluid of the heat supply loop 56. It shall be noted that the heat energy supplied to the first fluid 52 originates from subsystem 44. Although subsystem 44 is shown as a heat pump, the first fluid 52 may instead receive its heat energy from another source, e.g., a solar heater and a resistive heater 88, etc., provided that the heat supply loop 56 remains fluidly isolated from the fluid flow of fluid conductor 14. In one embodiment, the heating system 2 further includes a solar heater 90 connected to the storage container 17 via the outlet fluid conductor and the inlet fluid conductor of the storage container 17. Therefore, in addition to subsystem 44, the thermal battery 16 may additionally or alternatively receive thermal energy from the solar heater 90. A pump 92 is provided to allow circulation of the working fluid through the solar heater 90 to add thermal energy to the contents of the storage container 17. Again, the flow exiting the storage container 17 at the outlet fluid conductor is preferably disposed at the lowest temperature possible due to stratification of the contents of the storage container 17 to maximize heat transfer to the working fluid at the solar heater 90.

Figure 2:
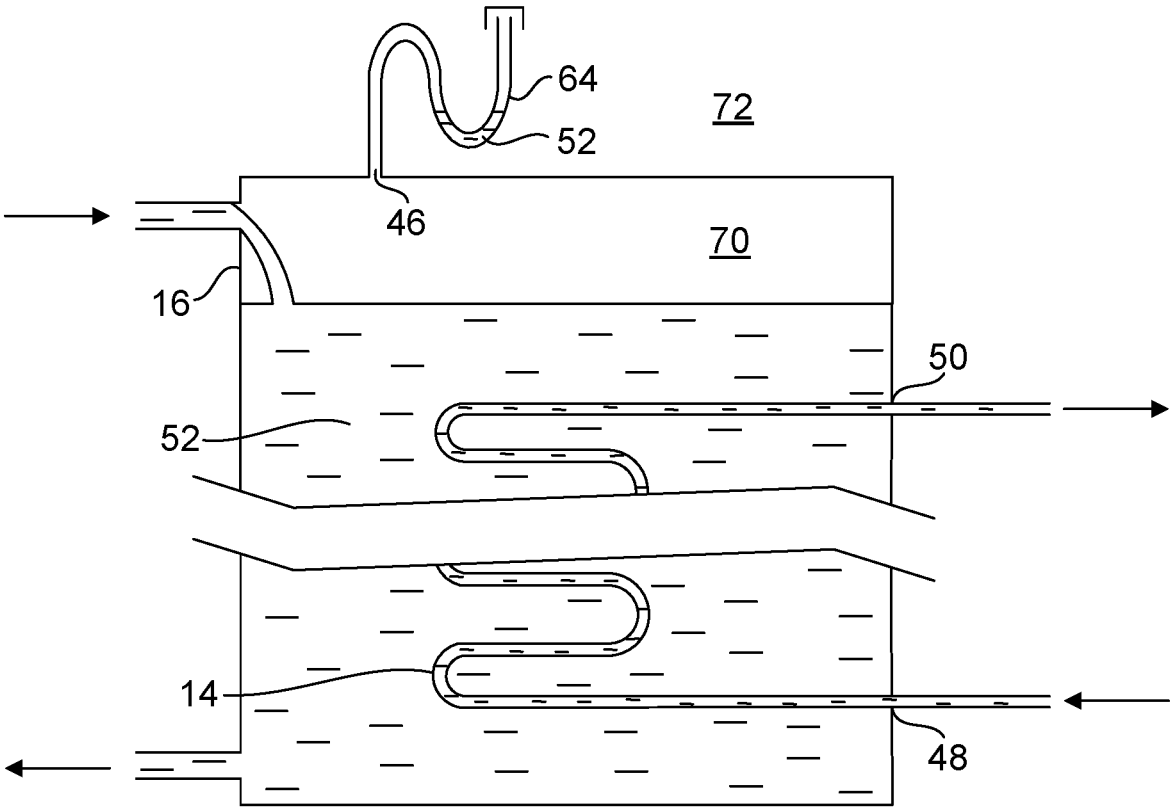
FIG. 2 is a diagram depicting a trap useful for reducing evaporation from a container while preventing external intrusions.

In one embodiment, the opening 46 includes a trap. FIG. 2 is a diagram depicting a trap 64 useful for reducing evaporation from a container while preventing external intrusions, e.g., of insects and dust, etc. The trap 64 is disposed over the opening 46 and includes a bent portion configured to hold a fluid, e.g., a portion of the contents of the storage container 17. In one mode of operation, during installation and start-up of the heating system utilizing this storage container 17, the bent portion need not be filled prior to the start of operation of the heating system. During use, evaporation of the contents of the storage container 17 tends to get trapped at the bent portion, filling the bent portion. Once this has occurred, escape of the contents of the storage container 17 through the opening 46 due to evaporation of the contents of the storage container 17 or the first fluid 52 is minimized due to the isolation provided by the trapped fluid in the bent portion although the escape of the trapped fluid at a minimal rate can still occur due to the small area of the trapped fluid that is exposed to the environment surrounding the container. It shall be noted that the ambient environment 70 of the contents of the storage container 17 is disposed at a pressure substantially the same as the atmospheric pressure of the environment 72 as the pressure exerted by the trapped fluid in the bent portion is largely negligible. Therefore, while blocked by a trapped fluid in the bent portion, the interior space of the storage container is substantially exposed to the atmospheric pressure.

Figure 3:
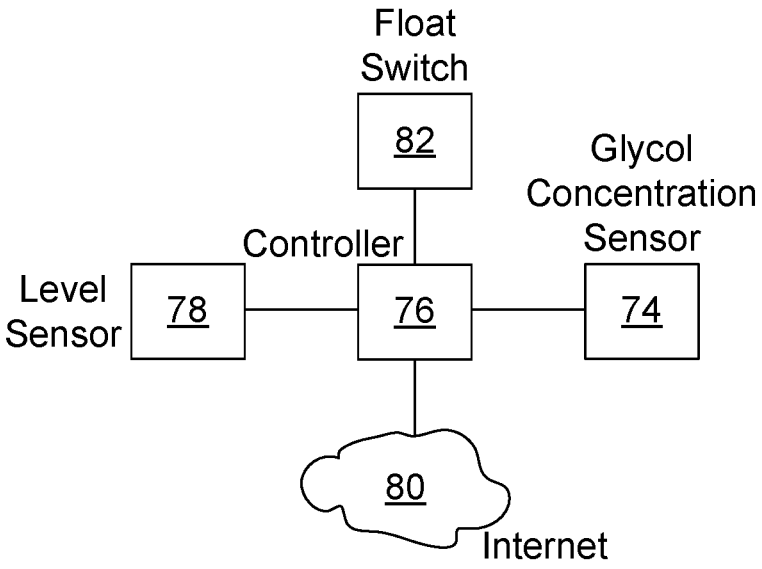
FIG. 3 is a diagram depicting a system for verifying the suitability of the contents of the storage container of FIG. 1.

FIG. 3 is a diagram depicting a system for verifying the suitability of the contents of the storage container 17 of FIG. 1. Referring to both FIGS. 1 and 3, a glycol concentration sensor 74, a level sensor 78 and a float switch 82 are each functionally connected to a controller 76. The system need not have all of these sensors or switch. However, with more than one sensor or switch, the true condition of the contents of the storage container can be ascertained in case one or more of the sensors or switch fail. The controller 76 is functionally connected to the internet 80 through which a zip code of the locale at which the heating system is disposed, can be obtained, e.g., by the use of Domain Name Systems (DNS). The DNS resolves queries for these names into Internet Protocol (IP) addresses for the purpose of locating devices, including the controller 76, worldwide. Additional look-up may be required which correlates raw or rudimentary location information with a well-established map. The practice of establishing location information based on DNS is not new. Although not shown in FIG. 1, the same controller 76 can be configured to control any equipment requiring control inputs in the heating system 2. Reference is made to U.S. Pat. No. 8,073,972 for a system and method for location discovery based on DNS, the specification for which is incorporated by reference in its entirety herein. The proper functioning of the thermal battery shown in FIG. 1 depends on several factors, e.g., the glycol concentration of the contents of the storage container and the level of the contents of the storage container. The glycol concentration needs to be sufficiently high to ensure that freezing of the contents does not occur. This factor is especially important in colder climates where the storage container and the heat supply loop 56 may be exposed to the influence of outdoor temperatures. The same sensor can also be used to determine whether the contents are present at the level the glycol concentration sensor is disposed. In this respect, the glycol concentration sensor is useful for determining the presence of the contents at the level at which the sensor is disposed. However, if the level of the contents 52 drops to a level where the contents no longer come in contact with the glycol concentration sensor 74, the glycol concentration sensor 74 will not report a reading. Therefore, in order to determine the level of the contents of the storage container and to determine the amount of glycol solution to add to the storage container, a level sensor 78 capable of providing the level of the contents 52 of the storage container is provided to supply the level information to a controller to ensure that heat transfer can occur properly due to sufficient contents in the storage container 17. The level of the contents of the storage container can also be ascertained using the float switch 82 as the right content level causes the float switch 82 to report a state indicating that the contents are disposed at an appropriate level.

Figure 4:
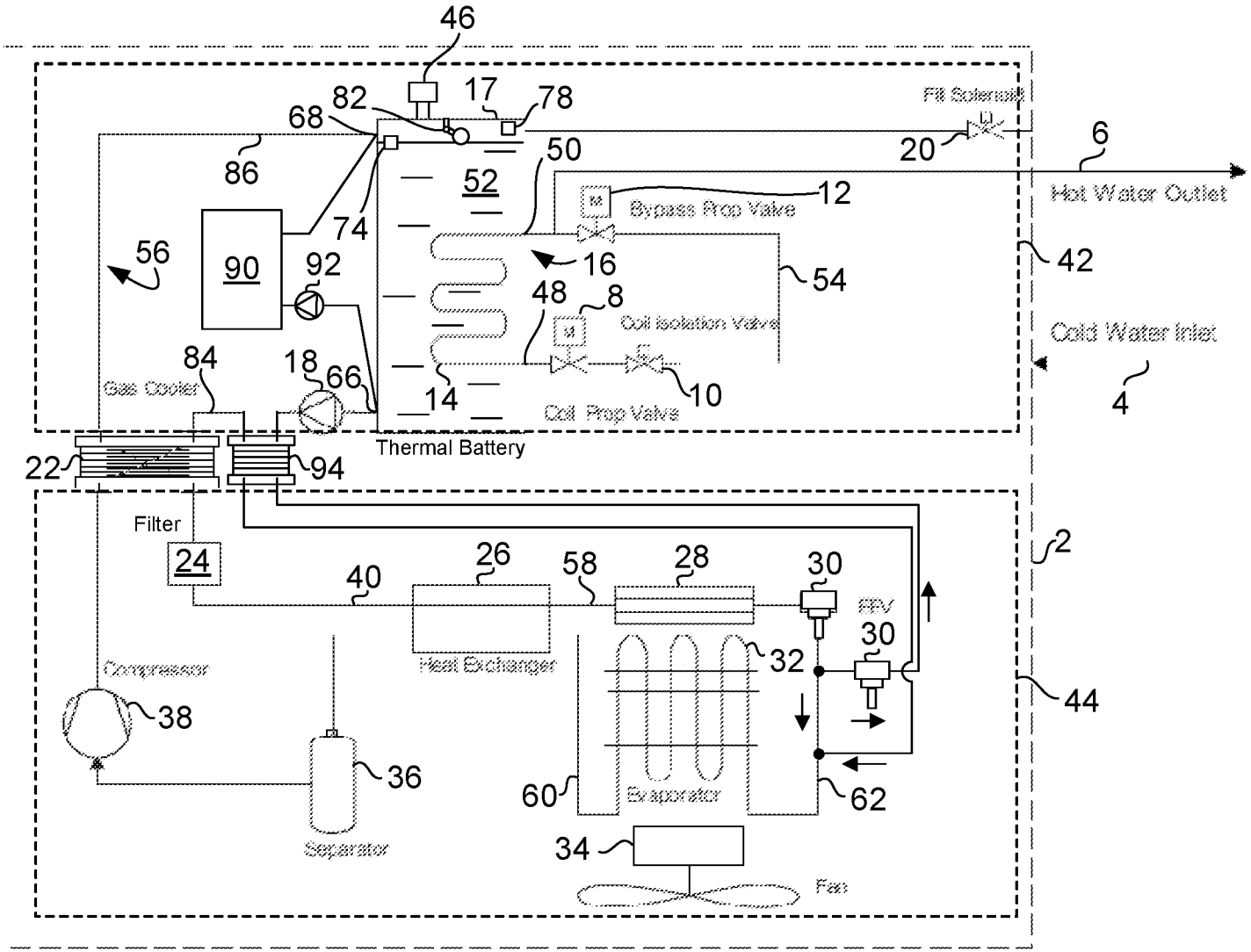
FIG. 4 is a diagram depicting an electric tankless heating system.

FIG. 4 is a diagram depicting an electric tankless heating system. Compared to the heating system 2 shown in FIG. 1, an additional heat exchange loop is provided where another expansion valve 30 is interposed in that loop and another heat exchanger 94 also interposed in this loop is connected in series with heat exchanger 22 and interposed in the outlet fluid conductor 84. Applicant discovered that by providing a secondary expansion valve 30 connected to a secondary heat exchanger 94 in the manner shown, the COP of the heat pump 44 can be further improved.

Figure 5:
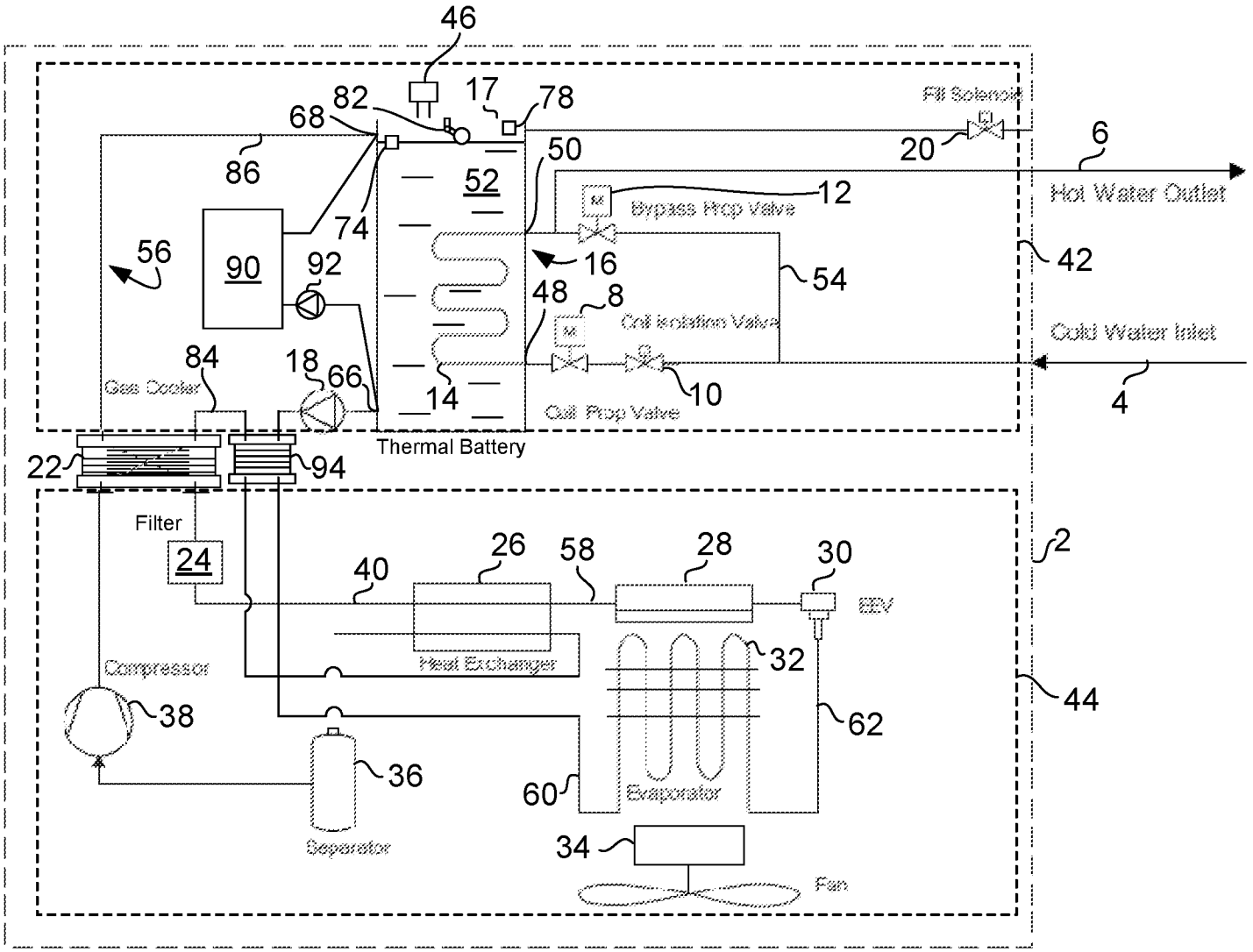
FIG. 5 is a diagram depicting an electric tankless heating system.

FIG. 5 is a diagram depicting an electric tankless heating system. Compared to the heating system 2 shown in FIG. 1, an additional heat exchange loop is provided between the evaporator 32 and the heat exchanger 26 and another heat exchanger 94 also interposed in this loop is connected in series with heat exchanger 22 and interposed in the outlet fluid conductor 84. Applicant discovered that by providing a secondary heat exchanger 94 in the manner shown, the COP of the heat pump 44 can also be further improved.

Figure 6:
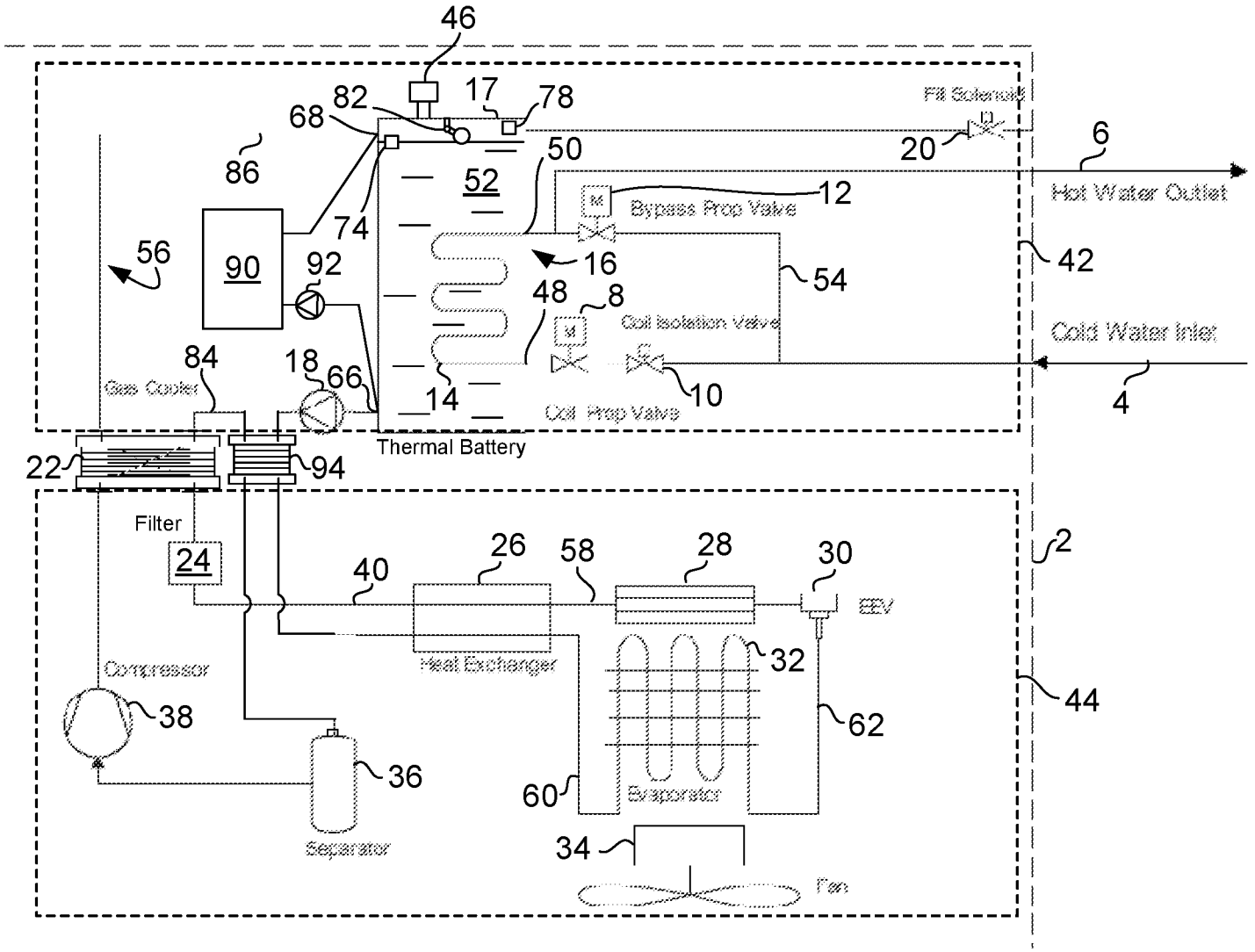
FIG. 6 is a diagram depicting an electric tankless heating system.

FIG. 6 is a diagram depicting an electric tankless heating system. Compared to the heating system 2 shown in FIG. 1, an additional heat exchange loop is provided between the heat exchanger 26 and separator 36 and another heat exchanger 94 also interposed in this loop is connected in series with heat exchanger 22 and interposed in the outlet fluid conductor 84. Applicant discovered that by providing a secondary heat exchanger 94 in the manner shown, the COP of the heat pump 44 can also be further improved.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A heating system comprising:

(a) a first fluid conductor configured to carry a working fluid upstream of an expansion valve;

(b) an evaporator disposed in an airstream and thermally connected to said first fluid conductor by a mode of convection, wherein said mode of convection is configured to be aided by a single blower; and (c) a second fluid conductor connecting said first fluid conductor to said evaporator, wherein the expansion valve is interposed in said second fluid conductor and the working fluid upstream of said expansion valve is configured to be received at said evaporator through said expansion valve and said second fluid conductor, wherein said first fluid conductor and said evaporator are positioned so that convective heat transfer from said first fluid conductor to said airstream lowers a temperature of the working fluid in said first fluid conductor upstream of the expansion valve, and said evaporator subsequently absorbs at least as much heat from the airstream as was lost from the working fluid, thereby compensating for the heat loss.

2. The heating system of claim 1, further comprising a heat exchanger comprising an upstream fluid conductor and a downstream fluid conductor thermally coupled to said upstream fluid conductor, wherein said upstream fluid conductor is configured to be connected to an inlet port of said first fluid conductor and said downstream fluid conductor is configured to be connected to an outlet port of said evaporator and heat transfer is configured to occur from the working fluid in said upstream fluid conductor to the working fluid in said downstream fluid conductor.

3. The heating system of claim 1, wherein said first fluid conductor comprises a featureless outer surface.

4. The heating system of claim 1, wherein the working fluid is a refrigerant.

* * * * *